US007692622B2

(12) United States Patent
Kim et al.

(10) Patent No.: US 7,692,622 B2
(45) Date of Patent: Apr. 6, 2010

(54) LIQUID CRYSTAL DISPLAY APPARATUS

(75) Inventors: Hyun-suk Kim, Suwon-si (KR); Jin-bog Kim, Taean-cup (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1218 days.

(21) Appl. No.: 11/115,234

(22) Filed: Apr. 27, 2005

(65) Prior Publication Data

US 2005/0237293 A1 Oct. 27, 2005

(30) Foreign Application Priority Data

Apr. 27, 2004 (KR) ..... 10-2004-0028942

(51) Int. Cl.
*G09G 3/36* (2006.01)

(52) U.S. Cl. ..... 345/102; 345/92

(58) Field of Classification Search ..... 345/600, 345/82, 629, 601, 92, 102, 147, 150, 153, 345/154, 211, 214, 691; 362/610, 494, 694, 362/295, 231; 359/586; 348/333.08, 441; 349/68; 353/31

See application file for complete search history.

(56) References Cited

U.S. PATENT DOCUMENTS 5,748,237 A * 5/1998 Ueda et al. ..... 348/333.08
5,790,096 A * 8/1998 Hill, Jr. ..... 345/600
6,129,444 A * 10/2000 Tognoni ..... 362/295
6,333,750 B1 * 12/2001 Odryna et al. ..... 345/629
6,611,249 B1 * 8/2003 Evanicky et al. ..... 345/102
6,717,559 B2 * 4/2004 Weindorf ..... 345/82
6,825,983 B2 * 11/2004 Bourdelais et al. ..... 359/586
6,888,529 B2 * 5/2005 Bruning et al. ..... 345/102
7,001,058 B2 * 2/2006 Inditsky ..... 362/610
7,052,138 B2 * 5/2006 Matsui ..... 353/31
7,195,381 B2 * 3/2007 Lynam et al. ..... 362/494
7,408,587 B2 * 8/2008 Matsutani et al. ..... 348/441
2001/0035853 A1 11/2001 Hoelen et al.
2002/0070914 A1 * 6/2002 Bruning et al. ..... 345/102
2002/0135572 A1 * 9/2002 Weindorf ..... 345/204
2002/0191104 A1 * 12/2002 Matsutani et al. ..... 348/441
2003/0079035 A1 * 4/2003 Boyd et al. ..... 709/231
2004/0036708 A1 * 2/2004 Evanicky et al. ..... 345/691
2007/0085816 A1 * 4/2007 Evanicky et al. ..... 345/102

FOREIGN PATENT DOCUMENTS

CN 1701350 A 11/2005
JP 1-179913 A 7/1989

(Continued)

*Primary Examiner*—Prabodh M Dharia
(74) *Attorney, Agent, or Firm*—Sughrue Mion, PLLC

(57) ABSTRACT

An LCD apparatus with an LCD panel displaying a picture thereon, including a backlight array in which a plurality of light emitting devices illuminating the LCD panel with a plurality of colors is arranged to have a predetermined pattern. A backlight driver drives each light emitting device to emit light and to adjust light intensity; and a controller controls the backlight driver to adjust a white balance of a picture displayed on the LCD panel. With this configuration, an LCD apparatus is provided, in which a white balance is adjusted without making a loss in a representable brightness level, i.e., brightness, and lowering a contrast ratio. Also included is an LCD apparatus, in which a white balance is adjusted according to formats of an input video signal.

10 Claims, 4 Drawing Sheets

FOREIGN PATENT DOCUMENTS

| | | | |
|---|---|---|---|
| JP | 10-117300 | A | 5/1998 |
| JP | 2001-135118 | A | 5/2001 |
| JP | 2003-121838 | A | 4/2003 |
| JP | 2003-255913 | A | 9/2003 |
| JP | 2004-86081 | A | 3/2004 |
| WO | 02/079862 | A2 | 10/2002 |

* cited by examiner

LIQUID CRYSTAL DISPLAY APPARATUS

CROSS-REFERENCE TO RELATED APPLICATIONS

This application claims the benefit of Korean Patent Application No. 2004-28942, filed 27 Apr. 2004, in the Korean Intellectual Property Office, the disclosure of which is incorporated herein by reference.

BACKGROUND OF THE INVENTION

1. Field of the Invention

Apparatuses consistent with the present invention relate to a liquid crystal display (LCD) apparatus, and more particularly, to an LCD apparatus which comprises a backlight array on which a plurality of light emitting devices illuminating an LCD panel with a plurality of colors is arranged to have a predetermined pattern, and controls the backlight array to adjust a white balance.

2. Description of the Related Art

An LCD apparatus uses a liquid crystal cell of which an inherent molecular arrangement is rearranged when a voltage is applied thereto such that the molecular rearrangement causes optical properties such as birefringence, line light, dichroism, light scattering, etc., thereby modulating light and displaying a picture.

As compared with other display apparatus such as a plasma display panel (PDP), a field emission display (FED), etc., the LCD apparatus cannot emit light itself and, instead, adjusts the light passing through an LCD panel, so that a separate light source is needed.

Therefore, the LCD apparatus comprises a backlight unit as well as the LCD panel so as to illuminate the LCD panel in a back thereof. Generally, the backlight unit comprises a lamp used as a light source; a light guided panel changing light emitted from the lamp into a surface light source and enhancing photo-efficiency and brightness; a prism sheet, and an optical sheet such as a polarizer. Additionally, an inverter controls light intensity of the lamp, thereby adjusting the brightness of a picture displayed on the LCD panel.

The lamp used as the light source is generally a cathode fluorescent lamp such as a cold cathode fluorescent lamp (CCFL), a hot cathode fluorescent lamp (HCFL), etc., which emits white light.

On the other hand, a phase alternate line (PAL) standard, a sequential couleur a memoire (SECAM) standard, or a national television system committee (NTSC) standard are currently used as a television broadcast standard. As such, a conventional LCD apparatus is designed to support only one among the foregoing broadcast standards, or support two or more among the foregoing broadcast standards. The conventional LCD apparatus adjusts a white balance according to each broadcast standard by applying a predetermined signal-processing algorithm to a video signal according to each broadcast standard.

For example, as a white balance adjusting method according to each broadcast standard, a maximum brightness is calculated by changing contrast gains of a red (R) signal, a green (G) signal and a blue (B) signal contained in the video signal, respectively. Therefore the R, G, B signals are adjusted in contrast at the maximum brightness, thereby adjusting the white balance.

Then, the white balance is adjusted by adjusting the brightness of the R, G, B signals at a minimum brightness of the video signal. Thereafter, a gamma value is set on the basis of the maximum and minimum values of the adjusted G signal and is identically set as to the R and B signals. Then, with regard to gradation of an adjustable range, the set gamma value of the G signal value is fixed and the set gamma values of the R and B signals are varied to thereby adjust the white balance.

However, in the conventional white balance adjusting method based on the cutoff value and the gamma correction of the R, G, B signals, the white balance is adjusted by changing the contrast and the brightness of the video signal, so that a contrast ratio of the conventional LCD apparatus is lowered. Further, the white balance is adjusted on the basis of the maximum and minimum brightness of the respective R, G, B signals, so that there is a loss in a representable brightness level, i.e., brightness.

SUMMARY OF THE INVENTION

Accordingly, it is an aspect of an exemplary embodiment to provide an LCD apparatus, in which a white balance is adjusted without making a loss in a representable brightness level, i.e., brightness, and lowering a contrast ratio.

Another aspect of an exemplary embodiment is to provide an LCD apparatus, in which a white balance is adjusted according to formats of an input video signal.

The foregoing and/or other exemplary aspects of the present invention are also achieved by providing an LCD apparatus with an LCD panel displaying a picture thereon, comprising a backlight array in which a plurality of light emitting devices illuminating the LCD panel with a plurality of colors is arranged to have a predetermined pattern; a backlight driver driving each light emitting device to emit light and to adjust light intensity; and a controller controlling the backlight driver to adjust a white balance of a picture displayed on the LCD panel.

According to an exemplary aspect of the present invention, the light emitting device comprises a red light emitting diode, a green light emitting diode, and a blue light emitting diode.

According to another exemplary embodiment, the LCD apparatus further comprises a format determiner that determines a format of a video signal on the basis of characteristics of the video signal inputted, wherein the controller controls the backlight driver to adjust the white balance of a picture displayed on the LCD panel according to the formats of the video signal determined by the format determiner.

According to an exemplary embodiment, the format determiner determines the format of the video signal on the basis of a horizontal frequency and/or a vertical frequency of the video signal.

According to another exemplary embodiment, the LCD apparatus further comprises a user input unit that generates a first control signal when operated by a user, wherein the controller controls the backlight driver to adjust the white balance of a picture displayed on the LCD panel according to the first control signals from the user input unit.

According to an exemplary embodiment, the controller controls the backlight driver to adjust a white tone of a picture displayed on the LCD panel according to a second control signals from the user input unit. The video signal may have, for example, an NTSC format, a PAL format, and/or a SECAM format.

BRIEF DESCRIPTION OF THE DRAWINGS

The above and/or other aspects and advantages of the present invention will become apparent and more readily appreciated from the following description of the embodiments, taken in conjunction with the accompany drawings of which.

DETAILED DESCRIPTION OF EXEMPLARY, NON-LIMITING EMBODIMENTS

Figure 1:
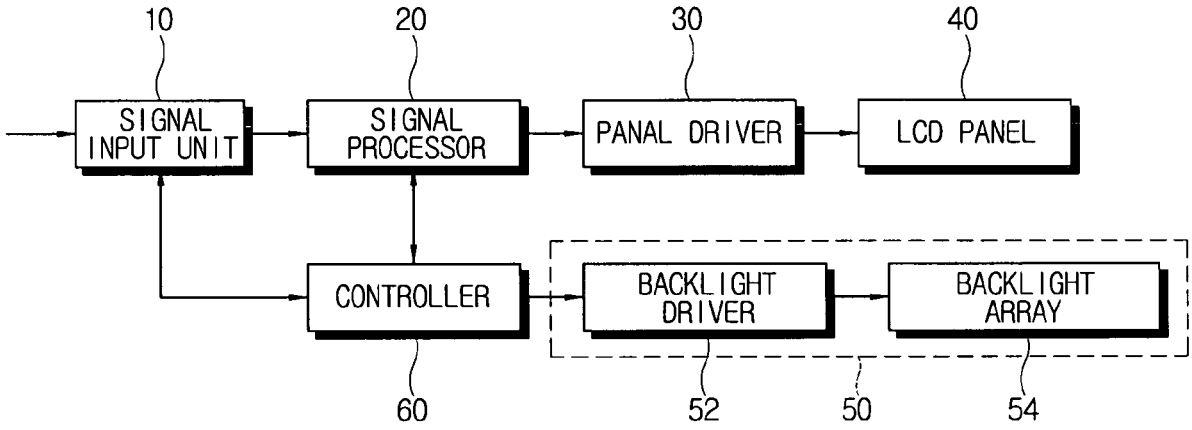
FIG. 1 is a control block diagram of an LCD apparatus according to an exemplary embodiment of the present invention.

Reference will now be made in detail to the exemplary embodiments of the present invention, examples of which are illustrated in the accompanying drawings, wherein like reference numerals refer to like elements throughout. The embodiments are described below in order to explain the present invention by referring to the figures.

As shown in FIG. 1, an LCD apparatus according to an embodiment of the present invention comprises a signal input unit 10, a signal processor 20, an LCD panel 40, a panel driver 30, a backlight unit 50, and a controller 60 which controls them.

The LCD panel 40 comprises a first substrate formed with a switching device and a pixel electrode; a second substrate formed with R, G, B color filters; and a liquid crystal sandwiched between the first and second substrates. A signal from the panel driver 30 is transmitted to the switching device via a source printed circuit board (PCB) and a gate PCB of the first substrate. Thus an electric signal is applied to the liquid crystal to transmit or intercept light emitted from a backlight array 54 or to adjust an amount of the transmitted light, thereby displaying a picture.

The signal processor 20 transforms a video signal that is input through the signal input unit 10 into a video signal having a format adaptive to a display part, namely the LCD panel 40. According to an embodiment of the present invention, the signal processor 20 comprises a scaler (not shown), a signal transformer (not shown) converting the video signal that was input through the signal input unit 10 into a signal suitable for the scaler.

According to an exemplary embodiment, the signal transformer comprises a tuner tuning in a signal selected among broadcast (radio frequency, RF) signals inputted through an antenna (not shown) or a cable (not shown), and a video decoder transforming the broadcast signal selected by the tuner to a signal having a format suitable for the scaler. Further, the signal transformer may comprise a transition minimized differential signaling (TMDS) receiver, a video decoder, or etc. to process a video signal inputted from an external video apparatus such as a digital video disc (DVD) player, a VCR (video cassette recorder), or the like. Here, the scaler transforms a video signal outputted from the signal transformer to have a vertical frequency, resolution, aspect ratio, etc. adaptive to an output scale.

The signal input unit 10 receives the video signal and transmits it to the signal processor 20. The signal input unit 10 may have various configurations corresponding to that of the foregoing signal transformer. For example, the signal input unit 10 may comprise an analog input terminal to transmit an input analog video signal to an analog/digital (A/D) converter, and a digital input terminal to support a low-voltage differential signaling (LVDS) or TMDS interface for a digital video signal input. Further, the signal input unit 10 comprises the foregoing antenna or the forgoing cable to receive the broadcast signals through the tuner.

The backlight unit 50 according to an embodiment of the present invention comprises the backlight array 54 and a backlight driver 52, and emits light, thereby allowing the LCD panel 40 to display a picture.

The backlight array 54 comprises a plurality of light emitting devices to illuminate with a plurality of colors. The light emitting device according to an embodiment of the present invention comprises a light emitting diode (LED). Here, the LED separately comprises an R-LED emitting red light, a G-LED emitting green light, and a B-LED emitting blue light. The LED may comprise a united LED which can selectively emit all red light, green light, and blue light.

Figure 2:
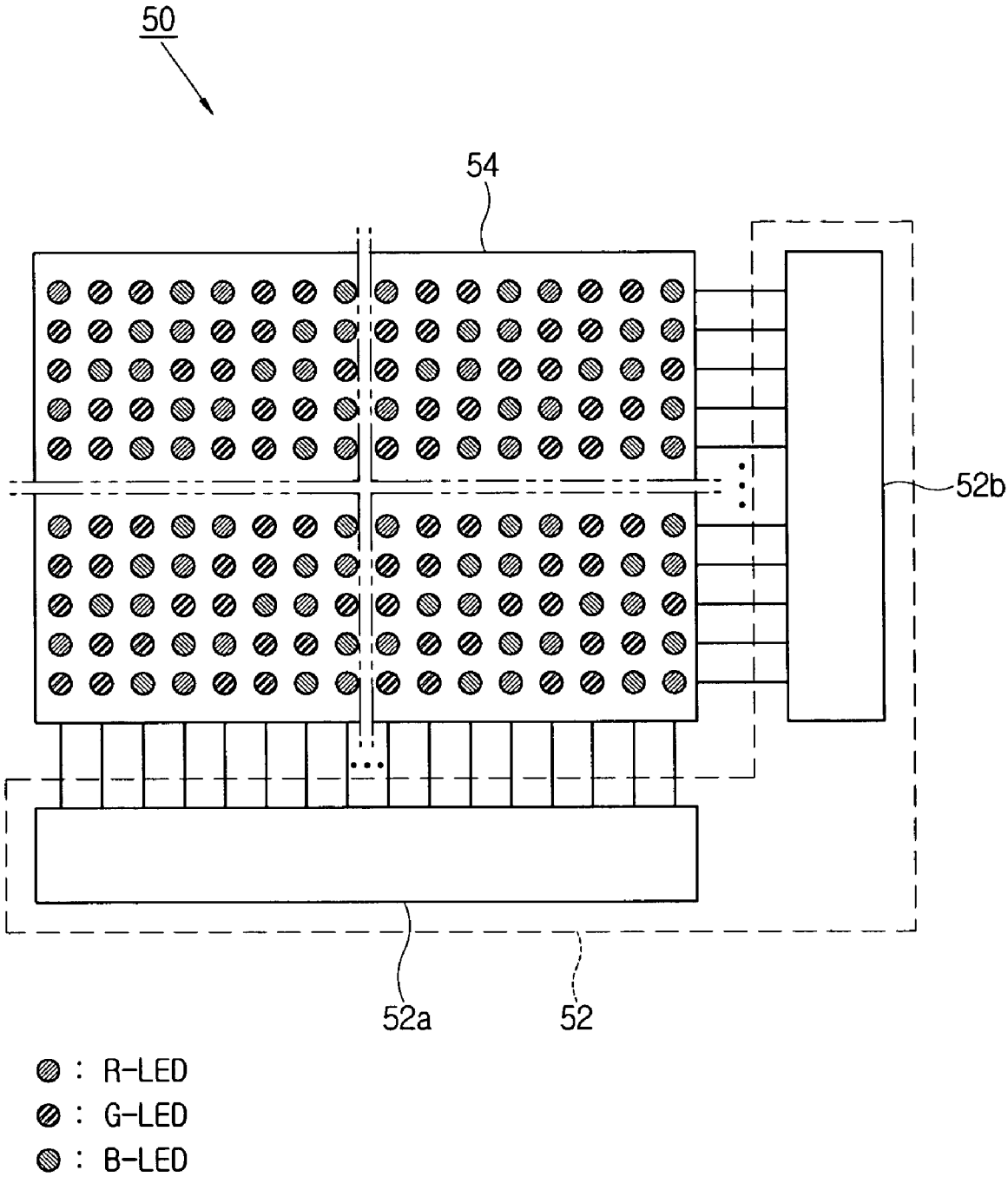
FIG. 2 is a schematic view of a backlight unit of an LCD apparatus according to an exemplary embodiment.
Figure 3:
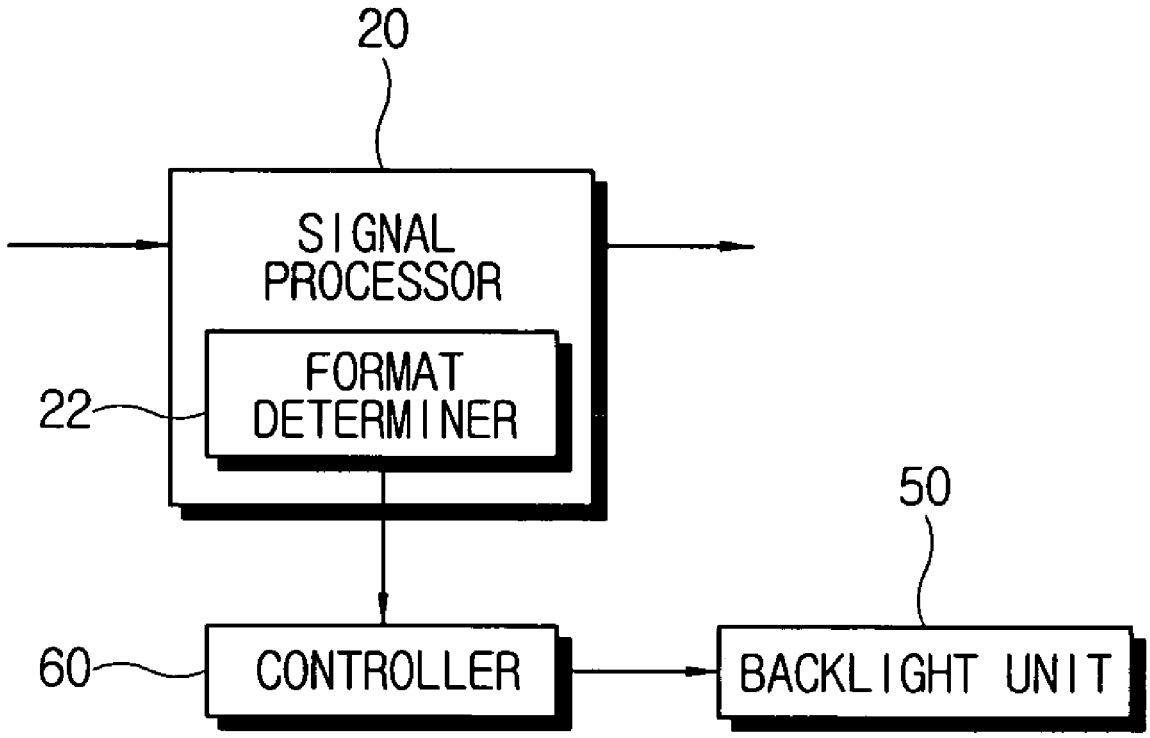
FIGS. 3 and 4 are control block diagrams of an LCD apparatus according to another exemplary embodiment.

The respective R-, G-, B-LEDs are arranged to have a predetermined pattern on the backlight array 54 as shown in FIG. 2. For example, the respective R-, G-, B-LEDs may have a pattern of "R-G-G-B-R-G-G-B-R-G-G-B . . . " along a transverse direction of the LCD panel 40. The respective R-, G-, B-LEDs may also have a pattern of "R-G-B . . . ", "R-R-G . . . ", or "R-G-B-B . . . ", etc, as further examples. That is, the respective R-, G-, B-LEDs are arranged to have an optimum arrangement pattern in consideration of the properties thereof such as the maximum brightness, etc., thereby allowing the LCD panel 40 to display a picture with natural color.

The backlight driver 52 drives the respective R-, G-, B-LEDs to emit light or not emit light and adjust an intensity of the emitted light in response to a control signal of the controller 60. The backlight driver 52 adjusts the intensity of electric current to be applied to the respective R-, G-, B-LEDs, and therefore adjusts the intensity of the light emitted from the respective R-, G-, B-LEDs, thereby adjusting a white balance or a white tone of a picture displayed on the LCD panel 40.

The controller 60 transmits the control signal to the backlight driver 52, wherein the control signal contains information about coordinate values and light intensity of the backlight array 54. On the basis of the control signal, the backlight driver 52 drives the respective R-, G-, B-LEDs to emit light and to adjust the light intensity thereof.

Here, the backlight driver 52 comprises a horizontal driver 52*a* and a vertical driver 52*b* in order to drive the respective R-, G-, B-LEDs to emit light and to adjust the light intensity thereof in response to the control signal transmitted from the controller 60. Therefore, the respective R-, G-, B-LEDs are controlled to emit the light and to adjust the light intensity thereof on the basis of combination of signals transmitted from the horizontal driver 52*a* and the vertical driver 52*b*.

Meanwhile, the LCD apparatus according to an exemplary embodiment, as shown in FIG . 3, comprises a format determiner 22 to determine a format of a video signal inputted through the signal input unit 10 on the basis of inherent properties of the video signal.

According to an embodiment of the present invention, the format determiner 22 determines what kind of the broadcast signal is inputted through the tuner among the broadcast signals, each having an NTSC format, a PAL format, and a SECAM format, for example, on the basis of the characteristics of the broadcast signal, such as a horizontal frequency and/or a vertical frequency. Generally, the broadcast signal according to the NTSC format has a vertical frequency of 525(lines/frame), and the broadcast signal according to the PAL format has a vertical frequency of 625(lines/frame), for example. The format determiner 22 counts the vertical frequency of each broadcast signal, thereby determining the format of the broadcast signal inputted through the tuner.

On the basis of the format of the broadcast signal determined by the format determiner 22, the controller 60 transmits the control signal according to a preset white balance corresponding to the determined format, to the backlight driver 52. Thus, the backlight driver 52 drives the respective R-, G-, B-LEDs to emit light and to adjust the light intensity, thereby adjusting a white balance of a picture displayed on the LCD panel 40.

For example, in the case of the broadcast signal of the NTSC format, the picture displayed on the LCD panel 40 should have a white balance of IR:IG:IB=2.6:5.1:1, so that the backlight driver 52 controls the light intensity of the respective R-, G-, B-LEDs to have the foregoing white balance. At this time, the controller 60 sets information about the optimum intensity of the light emitted from the respective R-, G-, B-LEDs in consideration of the optical properties of the respective color filters of the LCD panel 40.

Thus, the broadcast signal passes through the signal processor 20 without a conventional white balance adjustment, so that there is no loss in the brightness level and a contrast ratio is not lowered.

Figure 4:
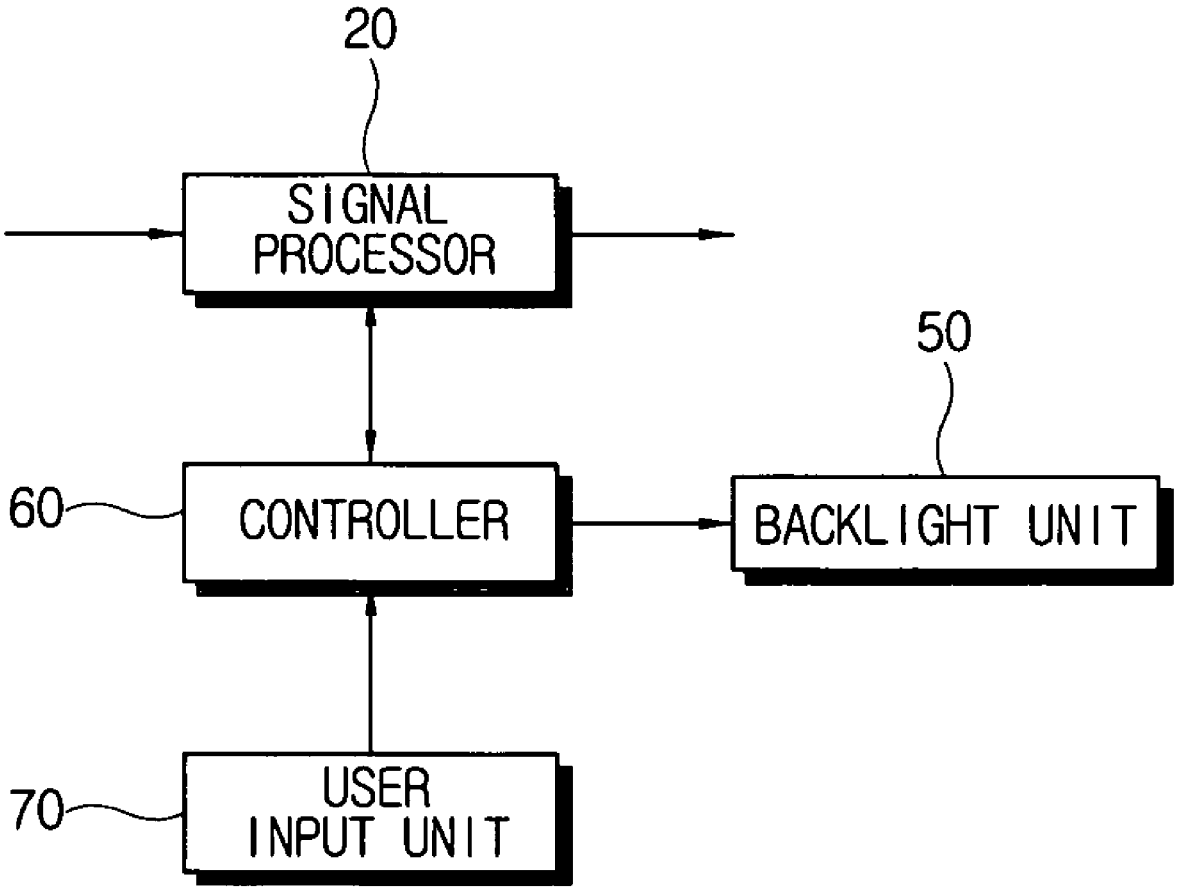

An LCD apparatus according to an exemplary embodiment, as shown in FIG. 4, comprises a user input unit 70 allowing a user to input a control signal. At this time, the controller 60 adjusts the white balance of a picture displayed on the LCD panel 40 in response to the control signal transmitted from the user input unit 70. That is, through the user input unit 70, a user can adjust the white balance of a picture displayed on the LCD panel 40.

Here, the user input unit 70 may comprise a selection button (not shown) provided in a front of the LCD apparatus, and a signal generator generating a control signal when the selection button is pressed. Further, the user input unit 70 may comprise a remote controller, and a remote signal receiver that generates a control signal in response to a remote signal received from the remote controller. The user input unit 70 may have various configurations as long as it can transmit a control signal to the controller 60.

Also, the controller 60 controls the backlight driver 52 to adjust the white balance of a picture displayed on the LCD panel 40 corresponding to the broadcast standard or the external video apparatus selected by a user through the user input unit 70. That is, the controller 60 can employ the selection of a user as a control signal, for example, the selection of the broadcast standard or the external video apparatus.

In the foregoing exemplary embodiment, the white balance is adjusted according to the broadcast standards of the video signal inputted through the tuner. However, the white balance may be previously set according to various formats of the video signal, for example, the formats of the video signal inputted from the external video apparatus such as a computer, a VCR, a DVD, etc., and the format of the video signal inputted through the signal input unit 10 can be determined, thereby adjusting the white balance through the backlight array 54 according to the formats. Therefore, the white balance adjustment according to the present invention is simple as compared with the conventional white balance adjustment performed in the signal processor 20.

In the foregoing embodiment, the white balance of a picture displayed on the LCD panel 40 is adjusted by controlling the backlight unit 50 according to the formats of the video signal or the selections of a user through the user input unit 70. However, a respective R-, G-, B-LED may be adjusted in the light intensity so as to represent the white tone a user prefers.

In the foregoing exemplary embodiment, the LCD apparatus comprises either the format determiner 22 or the user input unit 70. However, the LCD apparatus may comprise both the format determiner 22 and the user input unit 70.

Thus, there are provided the backlight array 54 in which a plurality of light emitting devices illuminating the LCD panel 40 with a plurality of colors is arranged to have a predetermined pattern; the backlight driver 52 driving each light emitting device to emit light and adjust the light intensity; and the controller 60 controlling the backlight driver 52 to adjust the white balance of an picture displayed on the LCD panel 40, so that the white balance is adjusted without making a loss in a representable brightness level, i.e., brightness, and lowering a contrast ratio.

As described above, the present invention provides an LCD apparatus, in which a white balance is adjusted without a loss in a representable brightness level, i.e., brightness, and lowering a contrast ratio.

Further, the present invention provides an LCD apparatus, in which a white balance is adjusted according to formats of an input video signal.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. An LCD apparatus with an LCD panel, comprising:

a backlight array in which a plurality of light emitting devices illuminate the LCD panel with a plurality of colors;

a backlight driver which drives the plurality of light emitting devices to emit light and to adjust light intensity; and a controller which controls the backlight driver to adjust a white balance of a picture displayed on the LCD panel, wherein the light emitting devices comprise a red light emitting diode, a green light emitting diode, and a blue light emitting diode, further comprising a format determiner which determines a format of an input video signal based on characteristics of the video signal, wherein the controller controls the backlight driver to adjust the white balance of the picture displayed on the LCD panel according to the format of the video signal as determined by the format determiner.

2. The LCD apparatus according to claim 1, wherein the format determiner determines the format of the video signal based on a horizontal frequency and/or a vertical frequency of the video signal.

3. The LCD apparatus according to claim 1, further comprising a user input unit generating a first control signal when operated by a user, wherein the controller controls the backlight driver to adjust the white balance of the picture displayed on the LCD panel according to the first control signal from the user input unit.

4. The LCD apparatus according to claim 3, wherein the controller controls the backlight driver to adjust a white tone of the picture displayed on the LCD panel according to a second control signal from the user input unit.

5. The LCD apparatus according to claim 3, wherein the video signal is an NTSC format, a PAL format, or a SECAM format.

6. The LCD apparatus according to claim 1, further comprising a user input unit which generates a first control signal when operated by a user, wherein the controller controls the backlight driver to adjust the white balance of the picture displayed on the LCD panel according to the first control signal from the user input unit.

7. The LCD apparatus according to claim 6, wherein the controller controls the backlight driver to adjust a white tone of the picture displayed on the LCD panel according to a second control signal from the user input unit.

8. The LCD apparatus according to claim 3, wherein the video signal is an NTSC format, a PAL format, or a SECAM format.

9. The LCD apparatus according to claim 6, wherein the video signal is an NTSC format, a PAL format, or a SECAM format.

10. The LCD apparatus according to claim 1, wherein the plurality of light emitting devices are arranged to have a predetermined pattern.

* * * * *